US009527662B2

(12) United States Patent
Goglio et al.

(10) Patent No.: US 9,527,662 B2
(45) Date of Patent: Dec. 27, 2016

(54) CARTRIDGE FOR COFFEE AND SOLUBLE PRODUCTS IN GENERAL

(71) Applicant: GOGLIO S.P.A., Milan (IT)

(72) Inventors: Franco Goglio, Milan (IT); Luca La Gamba, Daverio (IT); Donato Longhini, Daverio (IT); Giorgio Bottini, Gallarate (IT)

(73) Assignee: GOGLIO S.P.A., Milan (IT)

( * ) Notice: Subject to any disclaimer, the term of this patent is extended or adjusted under 35 U.S.C. 154(b) by 325 days.

(21) Appl. No.: 14/344,370

(22) PCT Filed: Oct. 5, 2012

(86) PCT No.: PCT/EP2012/069794

§ 371 (c)(1),
(2) Date: Mar. 12, 2014

(87) PCT Pub. No.: WO2013/053655

PCT Pub. Date: Apr. 18, 2013

(65) Prior Publication Data

US 2014/0366745 A1 Dec. 18, 2014

(30) Foreign Application Priority Data

Oct. 10, 2011 (IT) ..... MI2011A01847

(51) Int. Cl.
*A47J 31/00* (2006.01)
*B65D 81/00* (2006.01)
*B65D 85/804* (2006.01)

(52) U.S. Cl.
CPC ..... *B65D 85/8046* (2013.01); *B65D 85/804* (2013.01); *B65D 85/8043* (2013.01)

(58) Field of Classification Search
CPC .... A47J 31/3676; A47J 31/368; A47J 31/369; A47J 31/3623; B65D 85/8043; B65D 85/8046; B65D 85/804
(Continued)

(56) References Cited

U.S. PATENT DOCUMENTS 4,136,202 A * 1/1979 Favre ..... B65D 85/8043 206/0.5
5,656,311 A * 8/1997 Fond ..... B65D 85/8043 426/112
(Continued)

FOREIGN PATENT DOCUMENTS

WO 2010063644 A1 6/2010
WO 2010/079454 A1 7/2010
WO 2010/137952 A1 12/2010

OTHER PUBLICATIONS

International Search Report, dated Dec. 14, 2012, from corresponding PCT application.

*Primary Examiner* — Reginald L Alexander
(74) *Attorney, Agent, or Firm* — Young & Thompson

(57) ABSTRACT

A cartridge (1) for coffee or soluble products for the production of a beverage in an extraction apparatus by pressurized water, includes a container body (10), hermetically closed at the opposite bases thereof (30, 20), respectively for the water input and for the beverage output from the cartridge, wherein the body (10) is of a hollow tubular type and the opposite bases (30, 20) are membranes including a barrier film of aluminum (32, 22) and at least one plastic film (33, 23), and at least one incision (40, 41) provided in each of the plastic films (33, 23).

17 Claims, 3 Drawing Sheets

(58) Field of Classification Search
USPC ..... 99/295, 323.3; 426/77, 78, 79, 115
See application file for complete search history.

(56) References Cited

U.S. PATENT DOCUMENTS

| | | | | |
|---|---|---|---|---|
| 5,948,455 | A * | 9/1999 | Schaeffer | B65D 85/8043 426/112 |
| 7,490,542 | B2 * | 2/2009 | Macchi | A47J 31/3695 426/433 |
| 8,257,766 | B2 * | 9/2012 | Yoakim | B65D 85/8043 426/77 |
| 8,425,964 | B2 * | 4/2013 | Doglioni Majer | B65D 85/8043 426/431 |
| 8,850,960 | B2 * | 10/2014 | Biesheuvel | A23F 5/18 99/289 R |
| 2011/0283891 | A1 | 11/2011 | Mariller | |
| 2015/0093484 | A1 * | 4/2015 | Kamerbeek | A47J 31/0673 426/431 |

* cited by examiner

CARTRIDGE FOR COFFEE AND SOLUBLE PRODUCTS IN GENERAL

The object of the present invention is a cartridge, capsule or pod for the containing of coffee or in general soluble or extractable products in hot pressurised water or another extraction fluid for the preparation of beverages, as granular or powder products, for example barley, powdered milk and the like or leaf products, for example tea, camomile, infusions and the like.

Specific reference will be made herein below to a cartridge for the containing of coffee powder, without detriment to the fact that such a cartridge can be used for the containing of other soluble products for the preparation of beverages.

BACKGROUND OF THE INVENTION

Two types of cartridges for the containing of coffee powder are substantially widespread on the market: rigid cartridges and semi-rigid cartridges.

Rigid cartridges, having a substantially cylindrical or truncated cone shape, comprise two components in rigid plastic material heat-sealed or welded, with ultrasounds one in relation to the other. Placed inside the cartridge are the coffee powder and a filter in contact with the wall of the cartridge on the beverage output side.

Generally at least the wall of the cartridge on the water input side and possibly also that on the beverage output side is perforated. In this way, when the cartridge is inserted in an apparatus for the extraction of beverages, on the perforated input wall hot pressurised water is injected, which, traversing the powdered product inside the cartridge, retains the flavours so as to generate the beverage, which is dispensed on the output side of the cartridge.

This type of rigid cartridge has the disadvantage of the product in its interior being exposed to the outside environment, so that it requires a further hermetic packaging in order to preserve the product from contact with the outside.

This entails an additional cost of packaging.

Semi-rigid cartridges comprise a cylindrical or truncated cone container of reduced thickness, for example in aluminium, which after being filled with powdered product is closed with a breakable membrane, in such a way that the product is hermetically sealed inside the flexible cartridge.

When the semi-rigid cartridge is inserted in the apparatus for the extraction of beverages, a punch perforates a wall of the cartridge to allow the entry of hot water into the product for the formation of the beverage which is dispensed from the opposite wall, which is also perforated generally by means of an additional punch or a plate of the apparatus.

Such a semi-rigid sealed cartridge does not need an additional casing in order to preserve the flavour of the product.

However the sudden breakage of the walls of the cartridge does not allow an optimal retaining of the liquid inside the cartridge, and therefore the obtaining of a beverage of good quality.

WO2010/137952 describes a capsule for the containing of powdered products for the preparation of beverages, comprising a substantially rigid circumferential wall, closed below and above by means of a layer of filter in woven or nonwoven fibrous material. Said filter layers are perforated with mechanical means in order to allow the passage of the fluid.

U.S. Pat. No. 5,656,311 describes a capsule suitable for containing a powdered product for the production of beverages comprising a container body provided with a base, a lateral wall and an upper flange provided with a lip whereon a closure membrane is applied, provided with zones of lesser thickness suitable for facilitating the breakage thereof, which takes place by means of a tool suitable for perforating both the upper face and the lower face of the capsule.

WO 2010/063644 describes a capsule containing powdered product for the preparation of beverages by means of the passage of a liquid through said product using centrifugal forces. The capsule comprises a containing body with an open surface whereon a closure membrane is applied having a central portion and a peripheral portion suitable for being perforated by mechanical perforation means, in order to allow the input of the liquid and the output of the beverage from the capsule respectively.

SUMMARY OF THE INVENTION

The object of the present invention is that of eliminating the disadvantages of the prior art by providing a cartridge for coffee or soluble products which is versatile, practical, economical and of simple manufacture, of very high reliability in the continuative use by the common user thanks also to very simple and reliable preparation machines.

Another object of the present invention is that of providing such a cartridge for coffee or soluble products which is able to allow the production of a beverage of excellent quality.

A further object of the invention is that of providing such a cartridge which is able to guarantee a perfect conservation of the product in its interior, even for long periods, without using additional packaging casings. Another object is that of forming such a cartridge which does not require perforation systems, therefore avoiding maintenance of the same as well as the resulting soiling.

Yet a further object of the present invention is that of providing such a cartridge for coffee or soluble products which is able to allow a reduction in the costs of packaging of the same.

These objects are achieved by the cartridge for coffee or soluble products according to the invention which has the features described below and provided in the claims annexed to this document.

Substantially the cartridge for coffee or soluble products according to the invention comprises a container body which can be of substantially rigid plastic material, or in a flexible material, such as thin and/or laminated aluminium, of cylindrical or preferably truncated cone shape, without the bases, at which an outer annular edge or flange and an inner annular edge or flange are provided respectively. At these annular edges respective seal closure membranes are applied, constituted by a laminate comprising at least one film of plastic material, for example in CPP (cast polypropylene), coupled to a barrier film of aluminium or a very thin plastic film with easily tearable barrier properties. The plastic film has at least one incision, preferably obtained by means of laser, involving at least part of its thickness, suitable for facilitating the breakage of the membrane at a predetermined pressure of the fluid in the apparatus for the extraction of the beverage. According to an embodiment of the invention a plurality of small incisions are provided at areas of the plastic film not glued to the barrier film.

BRIEF DESCRIPTION OF THE DRAWINGS

Further features of the invention will be made clearer by the following detailed description referred to its embodiments purely by way of a non-limiting example, illustrated in the accompanying drawings, in which.

DETAILED DESCRIPTION OF THE PREFERRED EMBODIMENTS

Figure 1:
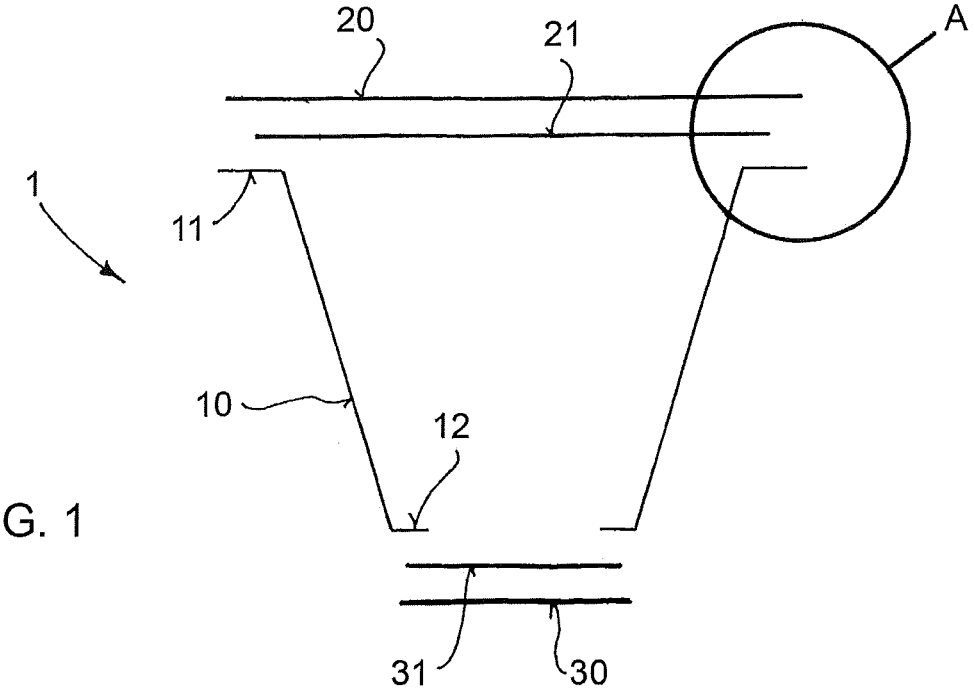
FIG. 1 is a schematic view in median section of a cartridge for coffee or soluble products according to the invention.
Figure 2:
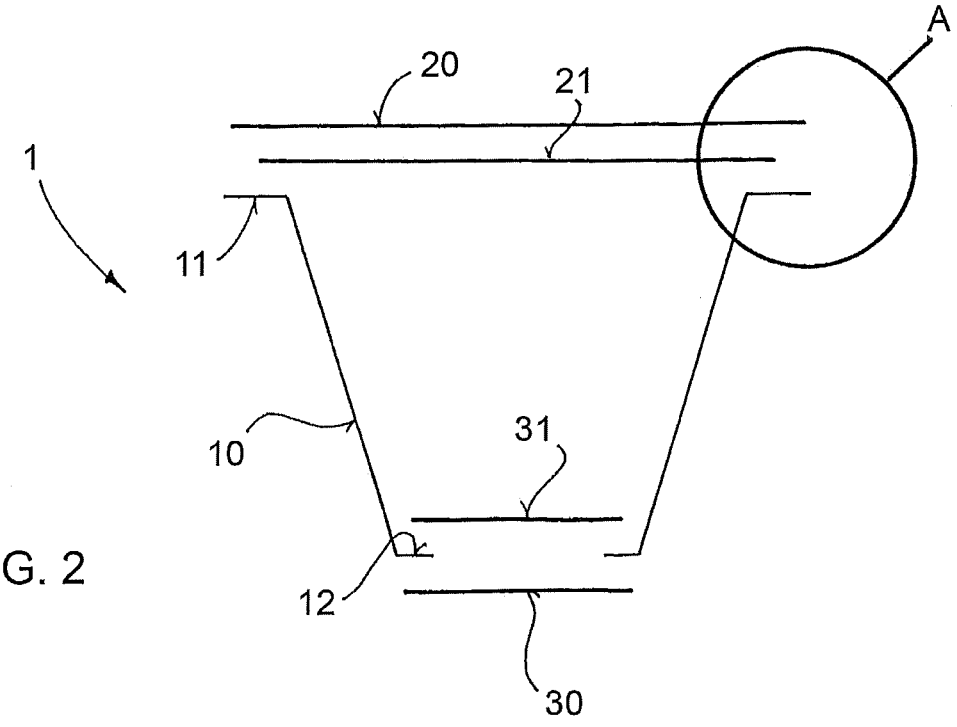
FIG. 2 is a view like FIG. 1, illustrating a slight variant of embodiment of the cartridge according to the invention.

Referring to these drawings and for the time being in particular to FIGS. 1 and 2, 1 denotes as a whole the cartridge or capsule for the containing of coffee or soluble products in general according to the invention. It comprises a container body 10, in the case in question with a truncated cone shape, without the bases, at which respective seal closure membranes 20, 30 are applied, after the interposition of respective filters 21, 31. More particularly, referring to the illustrations of the drawings, the body 10 has at the larger base, positioned above, an annular flange or edge with external development 11 and at the smaller base positioned below an annular flange or edge with internal development 12.

When the cartridge is inserted in an apparatus for extraction of the beverage it will have a water input side and a beverage output side, which in the following description will be supposed to be respectively the smaller base of the cartridge, at which the membrane 30 is positioned, and the larger base at which the membrane 20 is positioned.

Of course, without departing from the scope of the invention, the water input side and the beverage output side can be reversed with respect to those indicated.

The embodiments of FIGS. 1 and 2 differ only by the fact that at the water input side the filter 31 in one ease is positioned externally to the cartridge, between the annular flange 12 and the membrane 30 (FIG. 1), and in the other one internally to the cartridge (FIG. 2).

The filters 21, 31 are made preferably in nonwoven fabric, for example 100% PP, and are joined to the flanges 11, 12 of the body 10 of the cartridge by welding with heat or other systems, such as gluing and the like.

The body 10 of the cartridge can be formed in plastic material, for example through moulding of polypropylene PP, PLA, PBT or other, or through thermoforming of coextruded PP/EVOH/PP or other barrier structures.

Alternatively, the body 10 of the cartridge can be substantially flexible, obtained through deep-drawing of aluminium, also lacquered.

Figure 3:
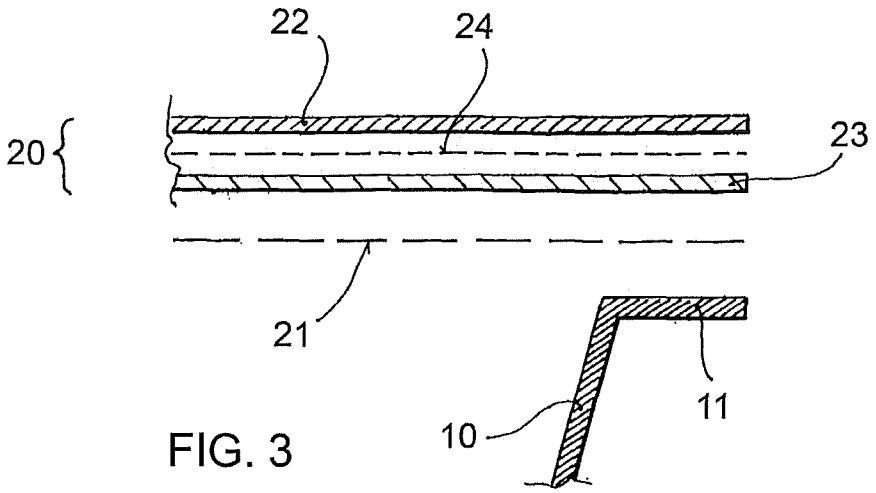
FIG. 3 is a blown-up enlargement of the detail denoted by A in FIGS. 1 e 2 in the case wherein the body of the cartridge is in, plastic material.

The enlargement of FIG. 3 shows the structure of the membrane 20 applied to the output side of the beverage from the cartridge 1, the structure of the membrane 30 on the water input side being the same.

In this drawing the filter 21 has been schematised with a dotted line.

The membrane 20 is obtained through lamination and comprises from the outside towards the inside, i.e. towards the zone in contact with the cartridge, an aluminium film 22 and at least one film of plastic material 23, such as cast polypropylene (CPP), coupled one to the other by means of a layer of adhesive 24.

The membrane 20 structured in this way is anchored to the flange 11 of the body 10 of the cartridge and to the underlying filter 21 by means of heat sealing or another system of attachment. The same occurs for the membrane 30 positioned on the water input side.

Figure 4:
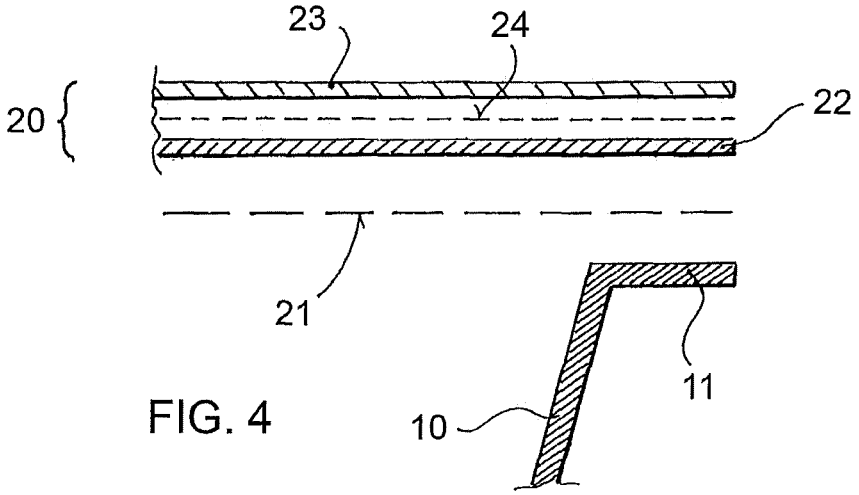
FIG. 4 is a view like FIG. 3, in the case wherein the body of the cartridge is in aluminium.

FIG. 4 is a view similar to that of FIG. 3 and illustrates the structure of the membrane 20 applied to the body 10 of a cartridge made in aluminium. The membrane 20 is again obtained through lamination of film and comprises in this case a film 22 of aluminium turned towards the body 10 of the cartridge and at least one outer film. 23 of plastic material, for example polyester (PET), coupled one to the other by means of an adhesive 24.

The membrane 20 is anchored to the body 10 of the cartridge and to the filter 21 conveniently again by means of welding with heat after interposition of a heat sealing lacquer.

The cartridge made in this way is completely hermetically sealed thanks to the aluminium barrier films and does not therefore require further packaging for the protection of the product contained therein against the external environment.

In order to allow the breakage of the membranes at a certain pressure of the water or of the beverage, the films in plastic material have at least one pre-incision, conveniently performed with laser, involving part or all of their thickness.

Figure 5:
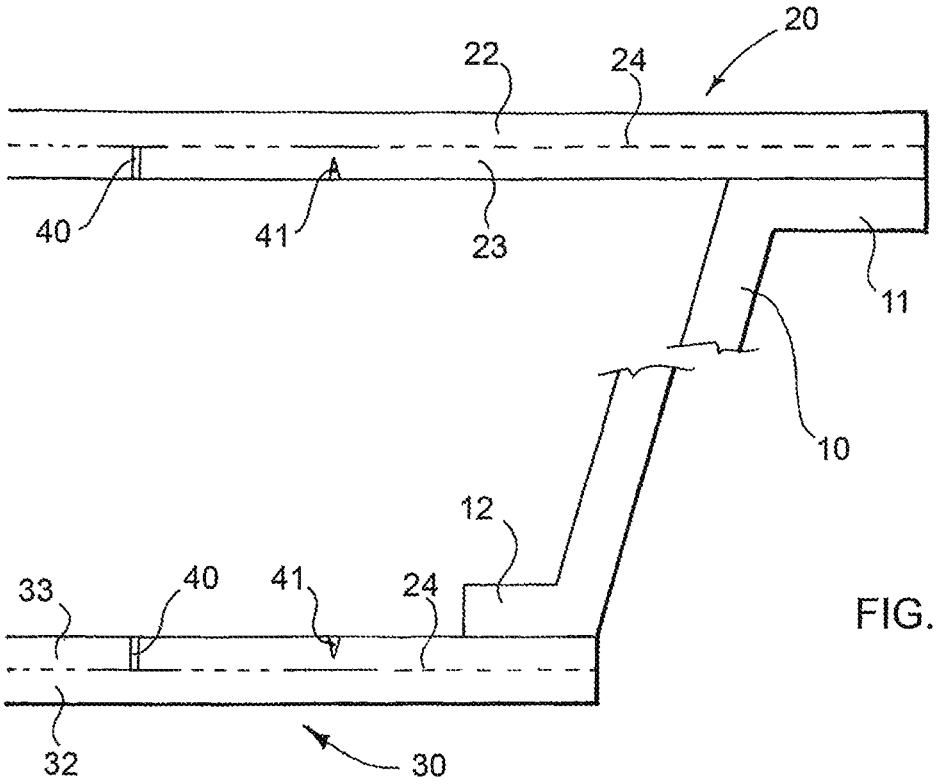
FIG. 5 is an enlargement of a part of a cartridge in plastic material as in FIG. 3, showing details of the closure membranes.
Figure 6:
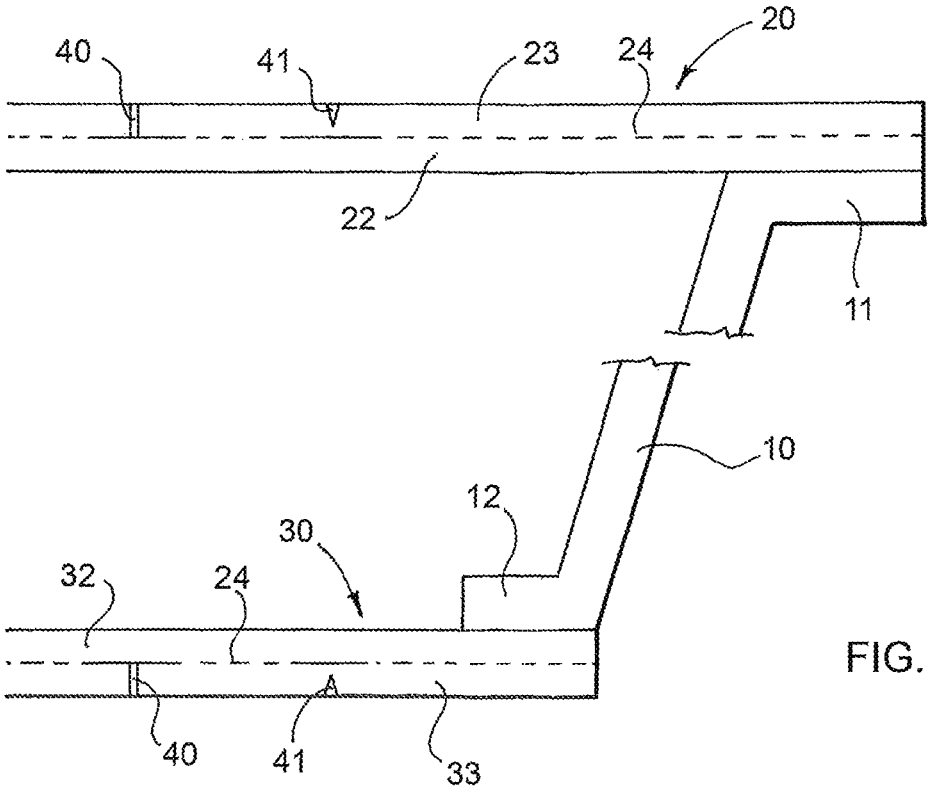
FIG. 6 is a view like FIG. 5, in the case wherein the cartridge is in aluminium.

The situation is illustrated in FIGS. 5 and 6, which show respectively a capsule with body 10 in plastic material and in aluminium respectively, with the filters 21, 31 omitted for simplicity.

These drawings show, purely by way of illustration, a laser incision. 40 which involves the entire thickness of the films 23, 33, therefore causing a cut of these films, and a less deep incision 41 which involves only part of the thickness of these films, determining a weakening thereof, but not the separation.

Naturally the type of incision of the plastic films 23, 33 of the membranes 20, 30 is chosen on the basis of the pressure of the liquid at which the breakage of the respective membrane is to take place, in particular of the membrane 20 on the beverage output side.

In fact a greater retaining of the liquid inside the cartridge 1 for the reaching of higher pressures causes a greater transport of flavours of the product and therefore a beverage of greater quality, which is normally not obtained when the cartridge is perforated with mechanical means.

The Applicant, who has performed numerous tests, was able to note that at least one incision 40 or 41 of the plastic films 23, 33 is necessary in order to obtain the breakage of the membranes at acceptable pressures, otherwise very high pressures would be necessary for the breakage of the membranes due to the elasticity of the plastic films, which would cause an unacceptable "jet" output of the beverage.

The provision of the cut 40, i.e. of an incision which involves the entire thickness of the film 23 or 33, allows the breakage of the membrane 20, 30 through tearing of the non-elastic film of aluminium 22, 32 at relatively low pressures. If the breakage at a higher pressure is required, an incision 41 is made not involving the entire thickness of the film 23, 33. In this case the breakage of the plastic film is facilitated by the incision 41 and obtained at a higher pressure than the previous one.

From the tests performed, the best results were obtained by forming on at least one of the membranes 20, 30, in particular that 20 positioned on the beverage output side, and preferably on both the membranes 20, 30, in areas of the plastic film 23, 33 not glued to the aluminium barrier film 22, 32, a plurality of small incisions 40 or 41, such as to cause, following the increase in the pressure of the liquid, the tearing of only the not glued small areas, preventing the tearing from propagating to the areas where the plastic and barrier films are coupled and the laminate constituting the membrane offers greater resistance.

In other words, the provision of small incisions at small areas without adhesive between the plastic film 23, 33 and the aluminium barrier film 22, 32 causes the formation of small apertures at these areas without adhesive, avoiding an indiscriminate propagation of the tearing which otherwise would occur, or could occur, if the triggering of tearing were to take place between the films of the membrane glued one to the other.

From what has been disclosed the advantages appear clear of the cartridge for coffee or soluble products in general according to the invention, which is hermetically sealed, which does not need mechanical means of perforation for the extraction of the beverage and which allows the beverage to be dispensed at the pressure required, and therefore a beverage of excellent quality to be obtained.

Naturally the invention is not limited to the particular embodiments previously described and illustrated in the accompanying drawings, but instead numerous detail changes can be made thereto, within reach of the person skilled in the art, without thereby departing from the scope of the same invention as defined in the annexed claims.

The invention claimed is:

1. A cartridge (1) for coffee or soluble products for the production of a beverage on an extraction apparatus by means of pressurised water or other extraction fluid, comprising:

a container body (10), hermetically closed at opposite bases thereof (30, 20), respectively, for water input and for beverage output from the cartridge, wherein said body (10) is of a hollow tubular type, and said opposite bases (30, 20) are membranes comprising a non-elastic barrier film (32, 22), an elastic plastic film (33, 23), and an adhesive provided therebetween, wherein on at least one of said membranes (20, 30), a plurality of small incisions (40, 41), that facilitate a breakage of the corresponding membrane (30, 20) at a predetermined pressure of the fluid in the apparatus for the extraction of the beverage, are provided on said plastic film (23, 33) at small areas of said plastic film that are free of the adhesive between the plastic film (23, 33) and the barrier film (22, 32), such to cause, following an increase in the pressure of the fluid, formation of small apertures at said small areas free of the adhesive and the tearing of only said small areas free of the adhesive, preventing the tearing from propagating to areas where said plastic film (23,33) and said barrier film (22,32) of said membrane (20,30) are glued one to the other by the adhesive.

2. The cartridge (1) according to claim 1, wherein said areas free of the adhesive between the plastic film (23) and the barrier film (22) are provided on the membrane (20) positioned on the beverage output side.

3. The cartridge (1) according to claim 1, said areas free of the adhesive between the plastic film (23, 33) and the barrier film (22, 32) are provided on both membranes (20, 30).

4. The cartridge (1) according to claim 1, wherein said at least one incision (40) is a cut which involves the whole thickness of the plastic film (33, 23).

5. The cartridge (1) according to claim 1, wherein said incision (41) involves only part of the thickness of said plastic film (33, 23) causing a weakening thereof.

6. The cartridge (1) according to claim 1, wherein said membranes (30, 20) are respectively anchored to an inner annular flange (12) and an outer annular flange (11) provided at the respective opposite ends of said body (10).

7. The cartridge (1) according to claim 1, wherein respective filters (31, 21) in nonwoven fabric are provided inside said membranes (30, 20).

8. The cartridge (1) according to claim 7, wherein said filter (31) is placed externally or internally with respect to said inner annular flange (12).

9. The cartridge (1) according to claim 1, wherein said body (10) is in plastic material, and said membranes (30, 20) comprise the respective films (33, 23) in plastic material in contact with said body (10).

10. The cartridge (1) according to claim 1, wherein said body (10) is in aluminum and said membranes (30, 20) comprise said film (32, 22) in aluminum in contact with said body (10).

11. The cartridge (1) according to claim 1, wherein said at least one incision (40, 41) is obtained by means of laser.

12. The cartridge (1) according to claim 1 wherein said body (10) is cylindrical, truncated cone, truncated pyramid or another shape.

13. The cartridge (1) according to claim 1, wherein said plastic films (33, 23) are coupled to the respective aluminum films (32, 22) through lamination by means of a respective layer of adhesive.

14. The cartridge (1) according to claim 6, wherein respective filters (31, 21) in nonwoven fabric are provided inside said membranes (30, 20).

15. The cartridge (1) according to claim 1, wherein the non-elastic barrier film is aluminum.

16. The cartridge (1) according to claim 1, wherein each membrane respectively comprises only one elastic plastic film.

17. The cartridge (1) according to claim 9, wherein the plastic material is any of polypropylene, coextruded PP/EVOH/PP, PLA, or, PBT, and the plastic material is cast PP.

* * * * *